US006293316B1

(12) United States Patent
Bertolotti et al.

(10) Patent No.: US 6,293,316 B1
(45) Date of Patent: Sep. 25, 2001

(54) METHOD OF FILLING WITH POWDER A CONTAINER THAT IS CLOSABLE BY A LID, AND ASSOCIATED APPARATUS FOR TRANSFERRING SAID POWDER

(75) Inventors: Gérard Bertolotti, Montreuil; Bernard Defontaine, Maurepas, both of (FR)

(73) Assignee: Compagnie Generale des Matieres Nucleaires, Velizy Villacoublay (FR)

( * ) Notice: Subject to any disclaimer, the term of this patent is extended or adjusted under 35 U.S.C. 154(b) by 0 days.

(21) Appl. No.: 09/542,853

(22) Filed: Apr. 4, 2000

(30) Foreign Application Priority Data

Apr. 22, 1999 (FR) ..... 99 05083

(51) Int. Cl.[7] ..... B65B 1/04
(52) U.S. Cl. ..... 141/20; 141/3; 141/302
(58) Field of Search ..... 141/2, 18, 3, 20, 141/85, 93, 67, 301, 302, 44, 45

(56) References Cited

U.S. PATENT DOCUMENTS 3,693,672 * 9/1972 Hiland ..... 141/7
3,880,207 * 4/1975 Giuffredi ..... 141/98
4,586,549 * 5/1986 White ..... 141/67
6,056,025 * 5/2000 Wegman ..... 141/67

* cited by examiner

*Primary Examiner*—Steven O. Douglas
(74) *Attorney, Agent, or Firm*—Dennison, Scheiner, Schultz & Wakeman

(57) ABSTRACT

A method and apparatus for filling with powder a container having an interior and an opening to the interior that is closable by a lid. The method includes the steps of docking the opening in the container with a transfer apparatus including a powder-feed duct and dropping a coupling tube vertically downwardly through the duct to communicate with the interior of the container. The powder is passed vertically downwardly through said transfer apparatus downstream from the powder-feed duct through the coupling tube to said container, with the coupling tube serving to protect internal mechanical parts of said transfer apparatus. During the transfer, a low level of suction is maintained inside the transfer apparatus to avoid any accumulation of the powder and any release of the powder outside the apparatus.

13 Claims, 17 Drawing Sheets

METHOD OF FILLING WITH POWDER A CONTAINER THAT IS CLOSABLE BY A LID, AND ASSOCIATED APPARATUS FOR TRANSFERRING SAID POWDER

BACKGROUND OF THE INVENTION

1. Field of the Invention

The present invention relates to a method of filling a container that is closable by a lid; the container is filled with a powder. The invention also relates to transfer apparatus associated with said method, which apparatus can be described as a "filler head".

Above, and below in the present text, the apparatus associated with said method of filling is referred to as "transfer apparatus". In any event, said transfer apparatus serves to guide and confine the powder which falls under gravity.

2. Description of Related Art

Said method and apparatus have been developed for the purpose of enabling a powder to be transferred while avoiding any dissemination of said powder outside said apparatus and while avoiding any accumulation of said powder within said apparatus.

Said method and apparatus are particularly suitable for discontinuous transfer of toxic powders, and in particular radioactive powders.

To resolve the technical problem involved, i.e. that of transferring a powder into a container for the purpose of filling the container while avoiding any dissemination of the powder, there exist known apparatuses and in particular apparatuses comprising a tubular body which defines a chamber that can be closed at its bottom end by a valve.

The body is provided with a docking port for receiving the container which is generally closed by a lid. Said port is consequently fitted with means for taking hold of said lid.

A powder-feed duct opens out into the top of the chamber.

After the container has been docked and its lid removed, the valve is opened to put the chamber into communication with the inside of the container.

The powder then flows into the container through the chamber.

To limit the risk of powder being disseminated to the outside, a small degree of suction is maintained in the inside volume of the entire apparatus by means of a ventilation system. The ventilation gas is extracted via a filter column in order to retain the powder entrained thereby.

Such apparatus, although effective, nevertheless leaves zones in which powder accumulates (valve, docking port, . . . ) which can lead to said powder becoming disseminated in operation; and the danger of such dissemination increases with increasing toxicity of said powder.

SUMMARY OF THE INVENTION

Faced with this technical problem, the invention proposes a method and associated apparatus for transferring powder into a container, in which implementation of the method and the apparatus serves to avoid both any leakage of the powder to the outside and any accumulation thereof within the apparatus.

In a first aspect, the invention thus provides a method of filling with powder a container that is closable by a lid. Said method comprises using transfer apparatus which includes a powder-feed duct for feeding said powder and means for putting said duct into communication with the inside of said container. In said method, in characteristic manner, during filling:

- the powder passes vertically downwards through the transfer apparatus and, downstream from said powder-feed duct, it does so in a lined well; such lining protecting the internal mechanical parts of said apparatus;
- a small level of suction is maintained inside said apparatus, including inside at least the bottom end of said powder-feed duct, in order to provide continuous ventilation and thus avoid any powder accumulating and any powder being disseminated to the outside.

In said method of the invention, both the external surroundings and the internal mechanical parts of the transfer apparatus are effectively protected from said powder: any dissemination of said powder is prevented because of the lining. In addition, because of the ventilation, said internal mechanical parts are protected better. Dynamic confinement is achieved by entraining into filter assemblies all traces of said powder that might accumulate. Naturally said ventilation must be performed with controlled intensity that is compatible with allowing the powder to drop under the effect of gravity.

The person skilled in the art will already have understood the advantage of the method of the invention for transferring a toxic powder into a container, and in particular a powder that is radioactive. The Applicant has specifically developed this method and the associated apparatus for the purpose of filling cylinders for packaging $PuO_2$ powders.

In the context of the method, it is advantageous for the ventilation which serves to provide dynamic confinement to be implemented as two mutually independent circuits.

The transfer apparatus including, from top to bottom:

- the vertical duct for feeding the powder;
- a spherical valve having a through cylindrical passage; and
- a case enabling the container without its lid to be docked, said case containing means for temporarily retracting said lid, the said two independent ventilation circuits are situated respectively in association with said powder-feed duct and in association with said docking case. The first is referred to as the "top" ventilation circuit, and the second as the "bottom" ventilation circuit.

In both of these top and bottom circuits, ventilation is provided continuously throughout the duration of transfer (i.e. while the powder is actually passing through the transfer apparatus), and also before and after said transfer, while the internal mechanical parts of the transfer apparatus are being arranged and rearranged. Arrangement is for the purpose of putting the powder-feed duct into communication with the inside of the container, while rearrangement is for the purposes of interrupting said communication and allowing the full container, as closed by its lid, to be withdrawn.

In general, ventilation is provided continuously throughout a period of operation during which n containers are filled. Ventilation can be stopped during two such successive periods of operation . . . , however given the nature of the powders transferred, it may be preferable to opt for ventilation through the transfer apparatus to be genuinely continuous.

Said ventilation is advantageously implemented in the bottom circuit in two different modes of operation in succession.

One of said modes of operation serves specifically to sweep the zone in which the retracted lid is received, and in particular to sweep the bottom face of said lid. Such sweeping is performed at the end of transfer.

In case it needs to be said, it is specified at this point that the ventilation within the apparatus of the invention is not "forced" ventilation using air that has been blown, but is ventilation that results solely from maintaining a small amount of suction inside the apparatus. Said ventilation is provided by the surrounding atmosphere being sucked in through admission orifice(s) provided for this purpose in the structure of the apparatus.

In a second aspect, the invention provides apparatus for transferring a powder into a container that is closable by a lid. Such apparatus, which can exist in several variants, is adapted to implementing the above-described method. In characteristic manner, said apparatus comprises:

in a top portion, a vertical powder-feed duct for feeding said powder, said duct being surrounded by a cylindrical sleeve over a certain height starting from its bottom end; said duct and said sleeve thus defining an annular space that is closed at its top end; said duct being suitable for being connected in the vicinity of its top end to apparatus for feeding it with said powder;

in a bottom portion, a case provided firstly with means for taking hold of the lid of the container, for retracting it, and for putting it back into place, and secondly with a vertical cylindrical recess that is open at its top and bottom ends, the shape of said recess enabling it to dock with the top portion of the container without its lid;

a spherical valve having a through cylindrical passage placed between said case and the bottom end of said vertical duct, and suitable, when in the open position, for putting said vertical duct into communication with the inside of said container;

a cylindrical coupling tube and means for moving said tube between a high position in which it is received inside the annular space defined by the bottom end of said duct and said sleeve, and a low position in which its bottom end is situated substantially level with the top portion of the container without its lid while the top end thereof remains in said annular space; said coupling tube in its low position serving to line the inside at least of the cylindrical passage through the valve; and ventilation means for ventilating the inside of said apparatus.

It will be understood that, while the powder is being transferred, said coupling tube thus provides the above-mentioned lining. During said transfer, the powder passes down successively through the inside of the duct, the inside of the passage through the spherical valve, and possibly through the inside of the recess in the case. More precisely, the powder passes successively inside the duct and then inside the coupling tube which lines said passage through the valve and possibly also through said recess in the case (which coupling tube lines the recess inside the case if the container is docked to the bottom end of said recess). The powder then drops into the container whose lid has previously been retracted. At the end of filling, said lid is put back into place.

The disposition of the various elements of the apparatus provides good confinement of the powder.

The sleeve, the coupling tube, the recess, and the passage are all stated to be "cylindrical". The person skilled in the art will understand that that refers mainly to the preferred shape for the various elements of the apparatus of the invention, and that the invention is naturally not limited to said shape. It is entirely possible for the apparatus of the invention to be implemented with at least one of its above-mentioned component parts having some other shape insofar, naturally, as said elements continue to be capable of co-operating with one another.

The means for ventilating the inside of said apparatus consist mainly in admission orifices—genuine admission orifices and/or clearances—and suction orifices that communicate via filter assemblies with extractor means (fans, . . . ). Said extractor means are situated downstream from the apparatus of the invention. It is recalled that ventilation is provided by sucking gas and not by blowing gas.

Advantageously, said ventilation means are organized as two mutually independent circuits:

a "top" circuit for sweeping the inside of the vertical duct, and the annular spaces that exist respectively between the outside wall of said vertical duct and the inside wall of the cylindrical coupling tube, and between the outside wall of said cylindrical coupling tube and the inside wall of the cylindrical sleeve; and a "bottom" circuit for sweeping the inside of the case.

Each of said circuits has at least one admission orifice and at least one suction orifice. The sweeping performed goes from the outside towards the filter assemblies.

To lower the coupling tube before transfer and then to raise it after said transfer, various types of means can be used, such as mechanical means controlled by a motor or electromagnetic means. The use of electromagnetic means is more particularly preferred.

The case enabling the container to dock can exist in several variants. Two main variants have been developed within the context of the present invention, but that does not exclude other variants in any way.

It will be understood that said case must have a profile that matches the top portion of the container that is to be filled. Thus, the two main variants mentioned above have been developed respectively for containers that have a neck at the top, and for containers that do not have a neck at the top.

The first of said variants intended specifically for containers having a neck is described below. In this variant, the case is provided with a bottom docking port whose profile matches said necks of the containers to be filled, and it contains a magazine that is mounted to pivot about a vertical axis. Said magazine has two vertical recesses, which are advantageously cylindrical in shape:

one of the recesses is open at both its top and bottom ends so as to provide a passage for the coupling tube when in its low position; said passage is suitable for being put into alignment with the vertical powder-feed duct, the passage through the valve, and the neck of the container so as to provide a well that is lined by said coupling tube when in its low position. The shape of said recess naturally matches that of the coupling tube (in this embodiment, the coupling tube in its low position passes through this recess in the case);

the other recess is open only at its bottom end and contains means for taking hold of the lid of the container, for retracting it, and for putting it back into place.

It will thus be understood that in use, said magazine can take up two positions corresponding respectively:

to taking hold of said lid and to putting it back into place; and to putting the powder-feed duct into communication with the inside of the container; the lid then being retracted.

For the purposes of taking hold of said lid, for retaining it, and for putting it back into place, suitable means are thus provided inside the recess of the magazine that is closed at its top end. In particular, these means can be constituted mainly by a pneumatic actuator having a member for taking hold of said lid mounted at its bottom end. Advantageously, said pneumatic actuator is a double-acting actuator and said means for taking hold of the lid is electromagnetic.

The bottom docking port of said case is advantageously designed both to enable docking to take place both without contact and with clearance, and also with contact and with substantially no clearance. These different types of docking correspond to two different modes of ventilating the bottom circuit.

When the container docks without contact, internal ventilation of the case is provided via the clearance at the docking port.

When said container docks with contact, said internal ventilation of the case needs to be provided from an admission duct. It is under such circumstances that special sweeping is implemented for the zone of the recess in which the lid is received.

It will thus be understood that in order to implement internal ventilation of the case in both above-described modes of operation, it is appropriate to fit the case with a closable admission duct.

In addition, said case is fitted with a suction duct that is connected to suitable suction means, and that communicates with filter assemblies.

In case it needs to be said, it is stated at this point that the internal ventilation of the case is mainly implemented on the one hand in the space that exists between said case and said magazine, and on the other hand in the recesses of said magazine.

In the context of this first variant, the case is a genuine docking case. It has a bottom docking port suitable for being put into communication with either of the two recesses of the magazine.

In the second variant of the case which is more specifically adapted to containers that do not have a neck, it is appropriate to refer to a "slide-type" case. In this variant, the case does not have a genuine docking port. Nevertheless it enables the container to dock and it contains a slide that can be moved sideways (retracted) between a position for taking hold of the lid of the container and for putting it back into place, and a disengaged position that leave the docking zone clear; said slide is provided with means for taking hold of the lid, for holding it in the retracted position, and for putting it back into place. In this variant, when the coupling tube is in its low position, it does not pass through the case.

In use, the slide can therefore take up two positions, as follows:

- a position for taking hold of the lid or for putting it back into place; and
- a position for putting the powder-feed duct into communication with the inside of the container; the lid is then retracted.

In order to take hold of said lid, to hold it in the retracted position, and to put it back into position, the slide is thus fitted with suitable means. Advantageously, said means are pneumatic.

In this variant, the coupling tube does not pass through the case. When in its high position, its bottom end is in the vicinity of the top flange of the valve (and this is also true of the variant described above); while in its low position said bottom end remains in the vicinity of the bottom flange of the valve.

Advantageously, said bottom end of the coupling tube has a flared endpiece shaped in such a manner as to enable it to co-operate with said top and bottom flanges of said valve. This co-operation improves confinement.

In this variant, the container docks to the bottom flange of the valve.

Whatever the embodiment of the apparatus of the invention, and in particular regardless of the way in which its case makes docking possible, said apparatus of the invention can also include weighing means supporting the container. This makes it easy to keep track of the extent to which said container has been filled.

BRIEF DESCRIPTION OF THE DRAWINGS

The method and apparatus of the invention will be better understood with reference to the accompanying figures.

The characteristics of said method and apparatus are described in greater detail and in non-limiting manner with reference to said figures.

FIG. 1: arrival of closed empty container (container having a neck)—ventilation system in operation;

FIG. 2: non-sealed docking of the container;

FIG. 3: removal of the lid from the container;

FIG. 4: pivoting the magazine (retracting said lid);

FIG. 5: opening the valve—lowering the coupling tube—filling;

FIG. 6: end of filling—sealed docking of the container—opening of the admission duct of the bottom circuit;

FIG. 7: raising the coupling tube—closing the valve;

FIG. 8: pivoting back the magazine—non-sealed docking of the container;

FIG. 9: closing the admission duct of the bottom circuit—putting the lid back into place; and FIG. 10: undocking the "full" and closed container.

FIGS. 1*a* to 10*a* correspond respectively to said FIGS. 1 to 10 and are cross-sections of said apparatus during the various stages of implementing the method (FIG. 1*a*: cross-section on Ia—Ia of FIG. 1 . . . FIG. 10*a*: cross-section on Xa—Xa of FIG. 10).

FIG. 11: arrival of closed empty container (container having no neck)—ventilation system in operation;

FIG. 12: removal and retraction of the lid—non-sealed docking of said container;

FIG. 13: opening the valve—lowering the coupling tube;

FIG. 14: filling;

FIG. 15: end of filling—raising the coupling tube;

FIG. 16: closing the valve; and

FIG. 17: lowering the container—putting the lid back into place—undocking the "full" and closed container.

DESCRIPTION OF THE PREFERRED EMBODIMENTS

Figure 1A:
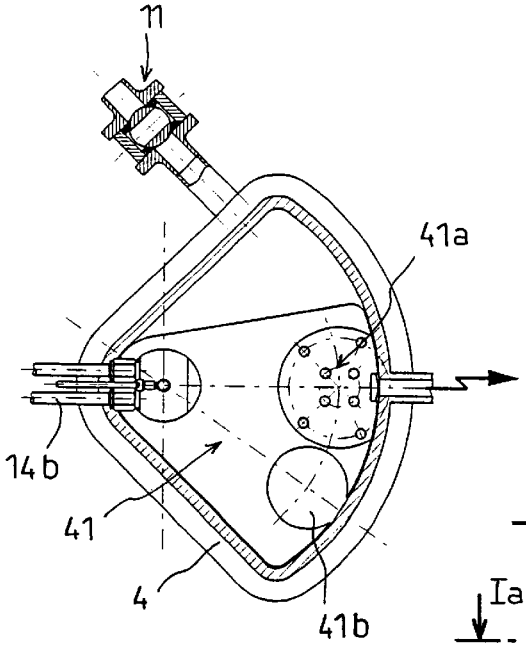
Figure 1:
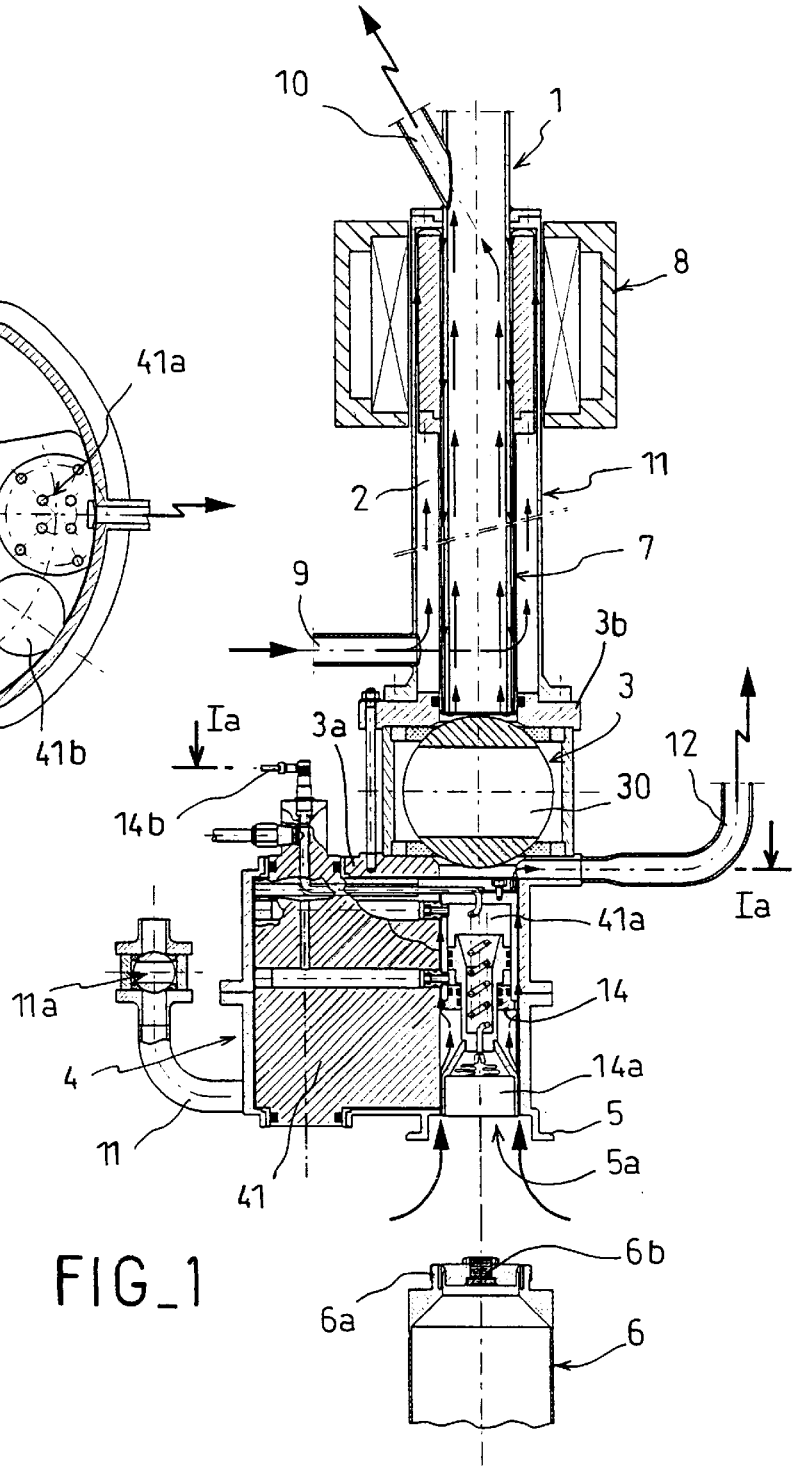
FIGS. 1 to 10 show a first variant of said apparatus in longitudinal section in elevation during various stages of implementing said method. The following legends are proposed for said figures.

On considering these series of figures, the person skilled in the art will understand that FIGS. 1 to 10 (and 1*a* to 10*a*) show the variant having a magazine-type case while FIGS. 11 to 17 show the variant having a slide-type case.

Whatever the variant, the apparatus of the invention as shown in FIGS. 1 to 10 and 11 to 17 is constituted:

- in its top portion by a vertical powder-feed duct 1 surrounded by a cylindrical wall or sleeve 11 defining an annular space 2 in which the coupling tube 7 is received and capable of being moved;

in its bottom portion, a case 4 provided with a port 5 for docking purposes and having a profile that matches the top portion of the container 6; and between said case 4 and duct 1, a spherical valve 3 having a cylindrical passage 30 therethrough.

The apparatus of FIGS. 1 to 10 and operation thereof are described in greater detail below. Said apparatus is particularly adapted to filling containers 6 having a neck 6*a*. It has a case 4 containing a magazine 41; the case 4 is provided with a bottom port 5 for docking purposes. During docking (with or without contact), the neck 6*a* of the container 6 penetrates into the mouth 5*a* of the port 5.

The fixed case 4 contains a magazine 41 that pivots about a vertical axis, being held by two bearings formed in said case 4. Gaskets provide sealing at said bearings.

To take hold of the lid 6*b* (FIGS. 2 and 3), the magazine 41 has a recess 41*a* put in register with said lid 6*b* of the container 6 once it has docked without contact, and a double-acting pneumatic actuator 14 slides in said recess. The piston rod of the actuator 14 has an electromagnetic gripping member or electromagnet 14*a* at its bottom end. At 14*b*, there are shown control means for said electromagnet. Where the rod passes through the cylinder, the cylinder gasket prevents any dissemination of the powder into the driving air.

After the lid 6*b* has been taken hold of and removed by the electromagnet 14*a*, the magazine 41 pivots to its position for putting the container 6 into communication with the valve 3.

In this position (FIG. 4) another recess 41*b* formed in the magazine is disposed in register with the mouth of the container 6.

The valve 3 is opened (FIG. 5), thus causing a well to be formed by bringing into vertical alignment the powder-feed duct 1, the cylindrical passage 30 through the valve 3, the recess 41*b* in the magazine 41, and said mouth of the container 6. The cylindrical coupling tube 7 previously received in the annular space 2 is then lowered by electromagnetic means 8 inside said well until it comes flush with the neck 6*a* of the container 6.

A gasket provides sealing between the top flange 3*b* of the valve 3 and the coupling tube 7.

The powder is then inserted into the container 6 through the lined well, thereby preventing any contact between the powder and the internal mechanical parts of the apparatus.

The filling up of the container, while it being docked in this way without contact, can be followed by weighing.

Figures 7, 7A:
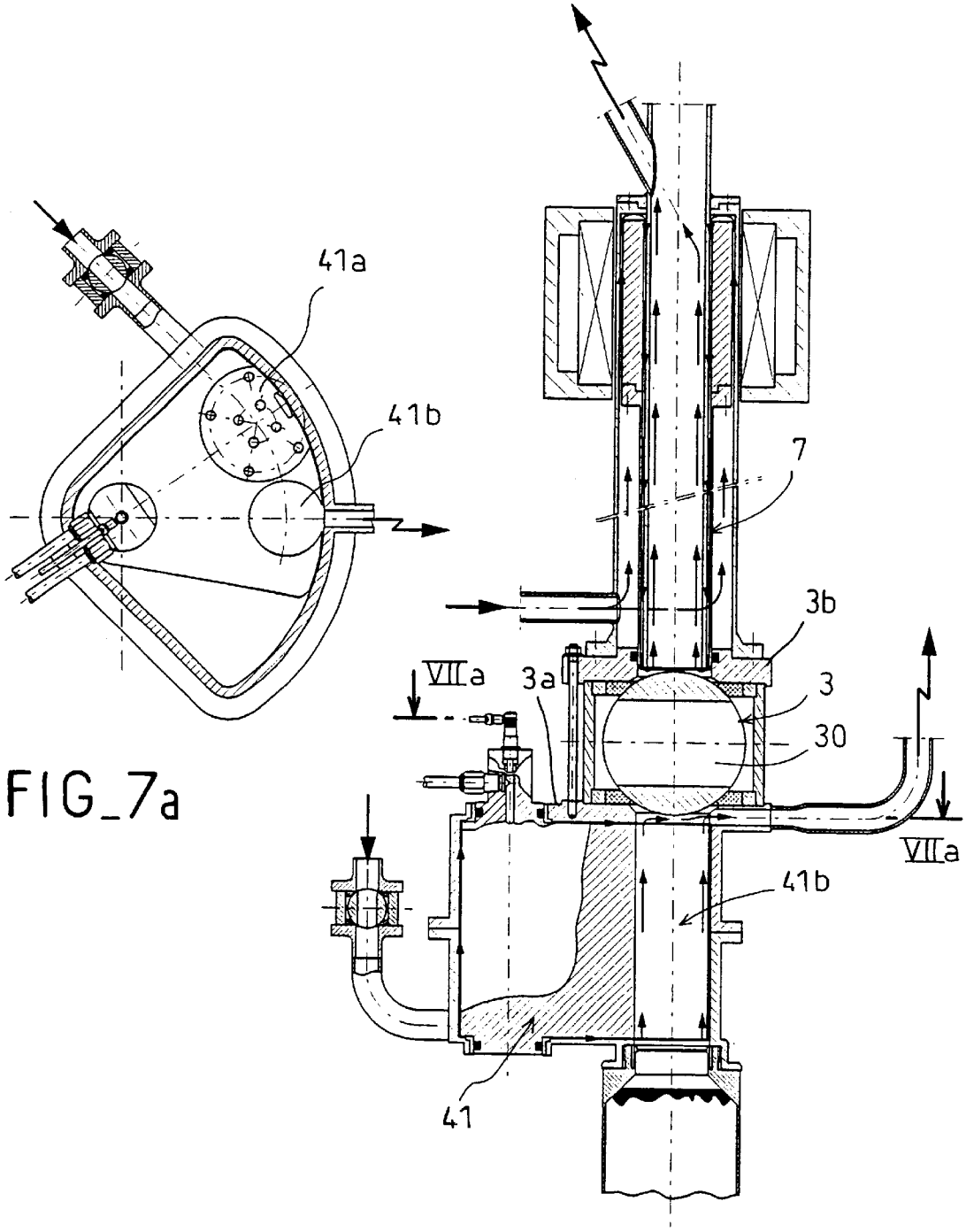
Figure 8:
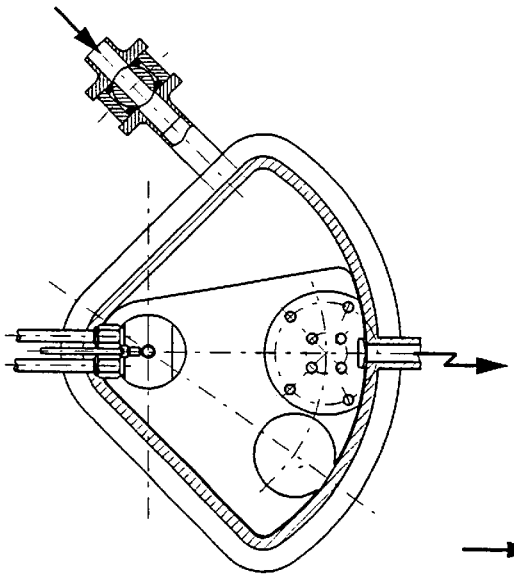
Figure 8A:
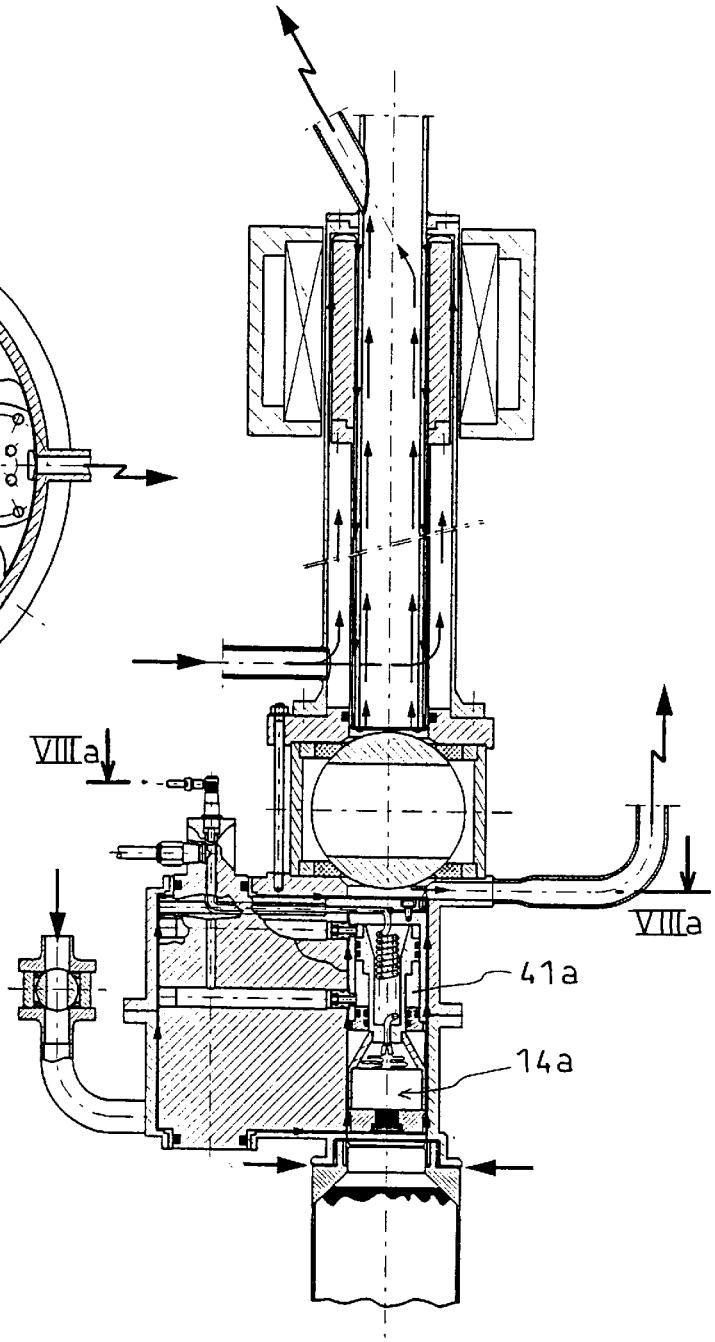
Figure 9A:
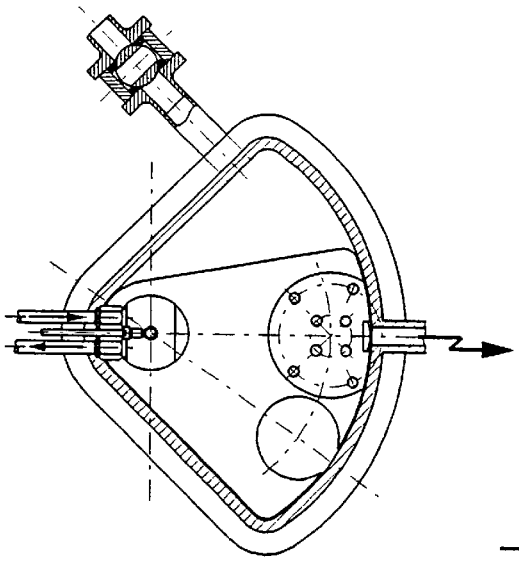
Figure 9:
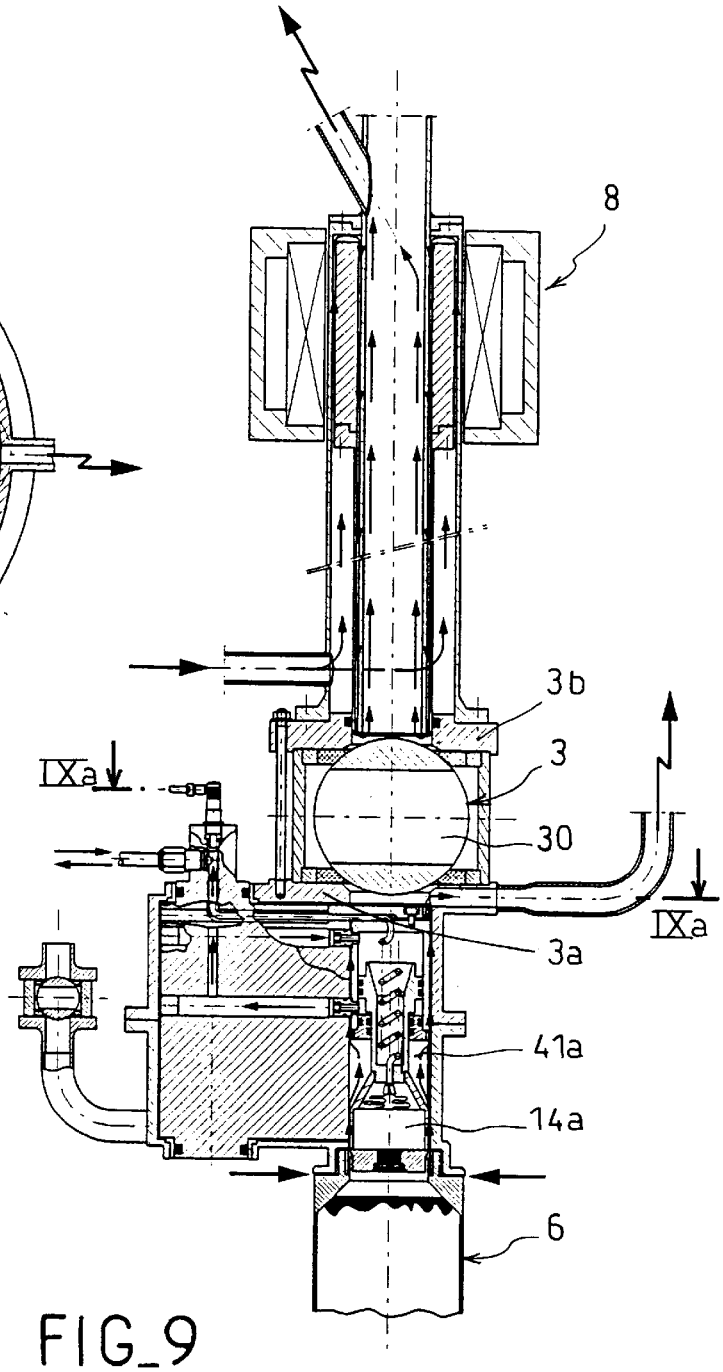

Once the container is full (filling may be partial or complete, at will), the coupling tube 7 is raised back into its initial high position, and then the valve 3 is closed (FIG. 7). The magazine 41 is then pivoted back into its initial position and the electromagnet 14*a* puts the lid 6*b* back into place on the neck 6*a* of the container 6 (FIGS. 8 and 9).

Figure 10A:
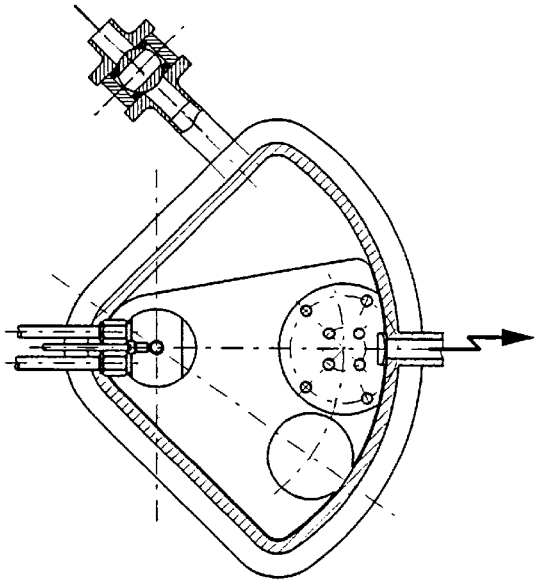
Figure 10:
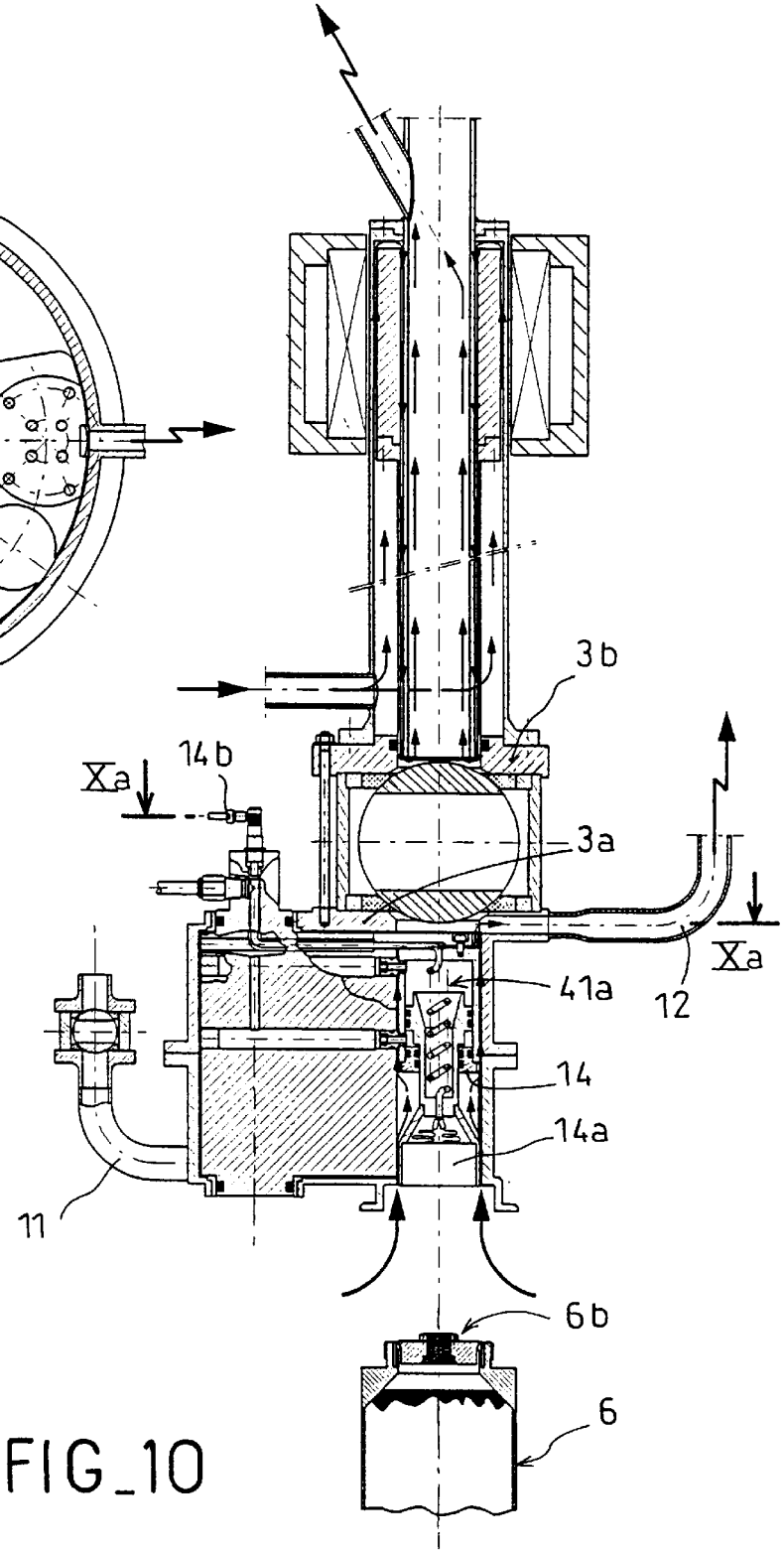

The full container 6, closed by its lid 6*b*, is undocked and can be transferred to a following unit (FIG. 10).

The ventilation which provides dynamic confinement is described below in greater detail with reference to FIGS. 1 to 10.

The ventilation system is made up of two circuits:

a top circuit which is generally formed by the annular space 2 and the powder-feed duct 1. The surrounding atmosphere (generally ambient air) is sucked in through an admission orifice 9 and is exhausted to filter assemblies via a suction orifice 10; and a bottom circuit which is formed mainly by the space lying between the case 4 and the magazine 41. This circuit is fed from the surrounding atmosphere (generally ambient air) either via the clearances and orifices situated at the docking port 5, or else via a closable admission duct 11. Said bottom circuit communicates with the filter assemblies via a suction orifice 12 disposed in the top of the case 4.

For ventilation purposes, two modes of operation are provided:

a) The spherical valve 3 is closed and isolates said top circuit from said bottom circuit. The coupling tube 7 is raised and surrounds the powder-feed duct 1 (FIGS. 1 to 4). Said top and bottom circuits then operate completely independently of each other.

In said top circuit: the atmosphere (air) sucked in through the admission orifice 9 rises in the annular space between the inside wall of the cylindrical sleeve 11 and the outside wall of said coupling tube 7; it moves down in the space between the inside wall of said coupling tube 7 and the outside wall of the duct 1; and then it rises via said duct 1 to the suction orifice 10. Before rising towards said suction orifice 10, it sweeps the portion of the outside surface of the spherical valve plug that is exposed in register with the opening in the top flange 3*b* of the valve 3, thereby preventing any powder being deposited in said zone.

Figure 2A:
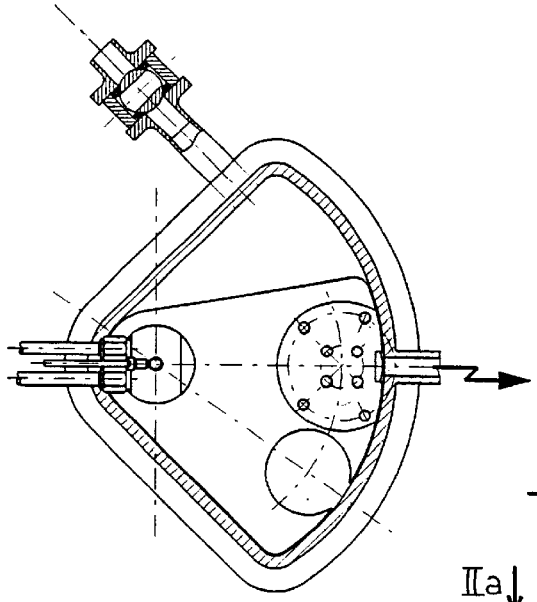
Figure 2:
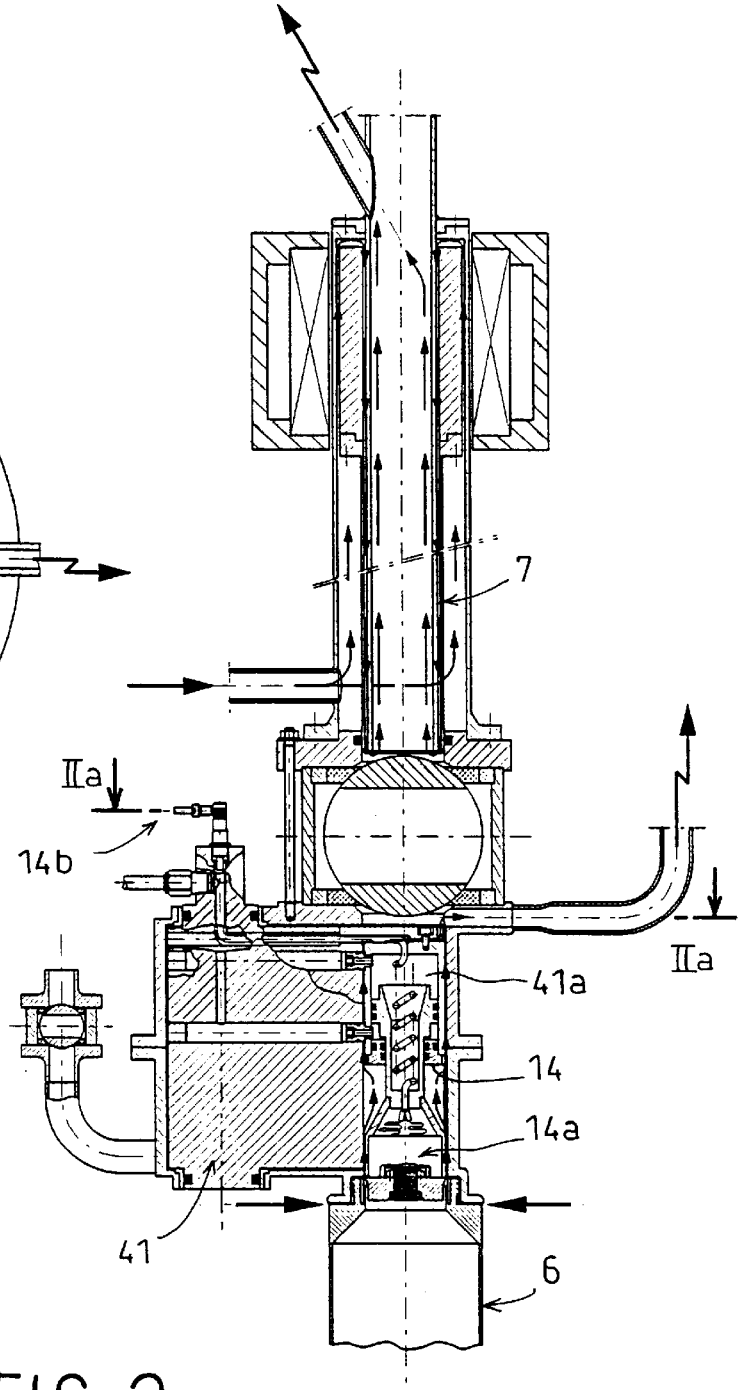

In said bottom circuit: while waiting for a container 6 (FIG. 1), the surrounding atmosphere (air) is sucked in through the mouth 5*a* of the port 5 in the case 4 and rises in the annular space defined between the case 4, the recess 41*a*, and the actuator 14. When said container 6 is docked, clearance remains between the container and the port 5, leaving an inlet for the surrounding atmosphere. This clearance also makes weighing possible, should that be desired (FIG. 2).

Figure 3A:
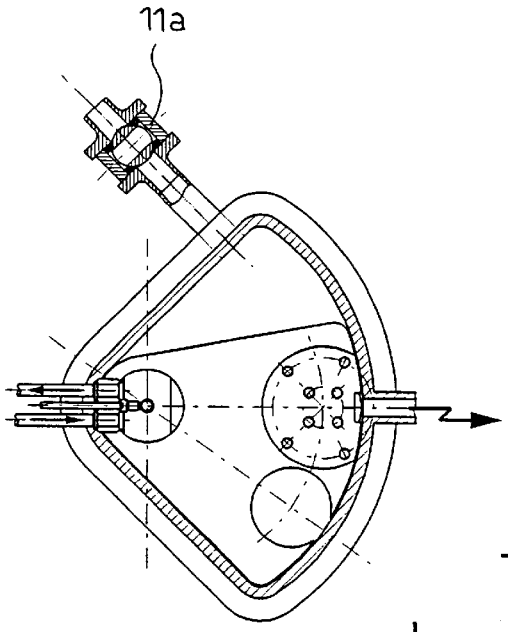
Figure 3:
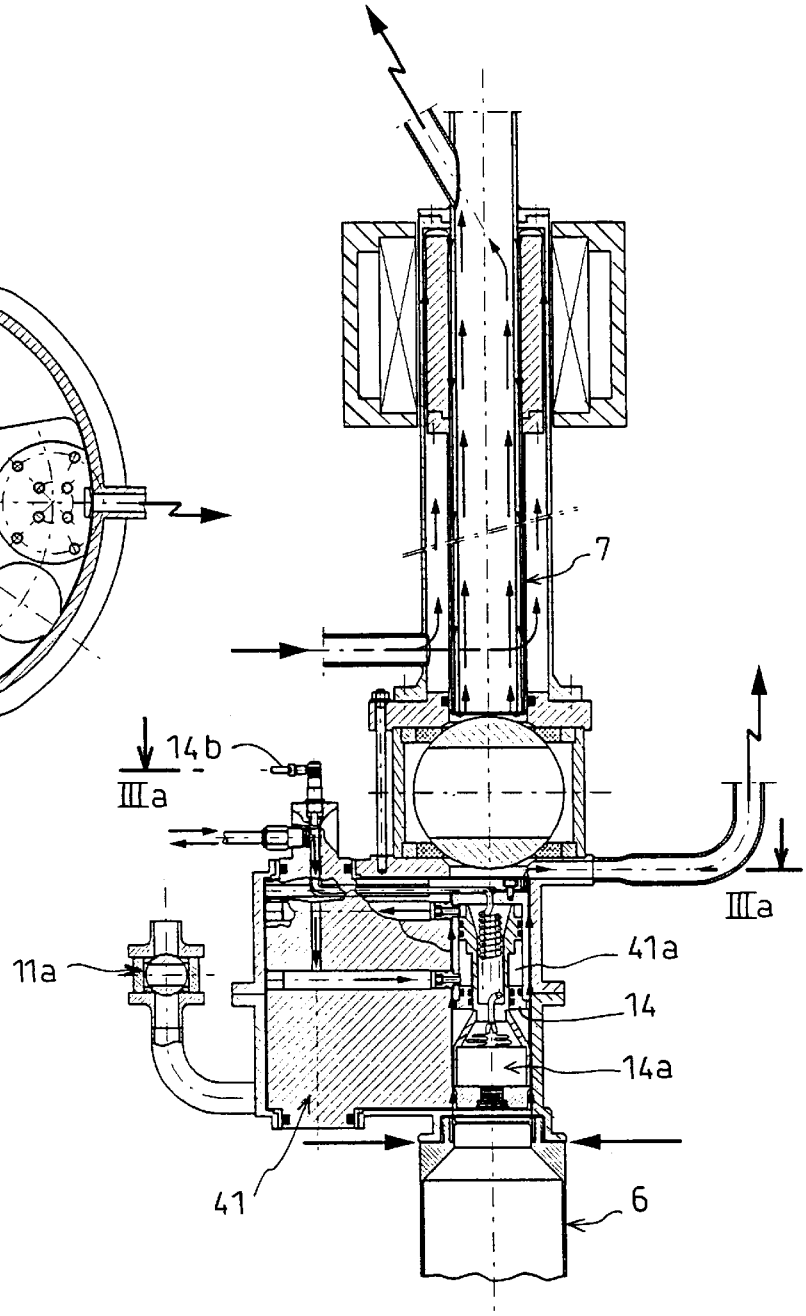
Figure 4A:
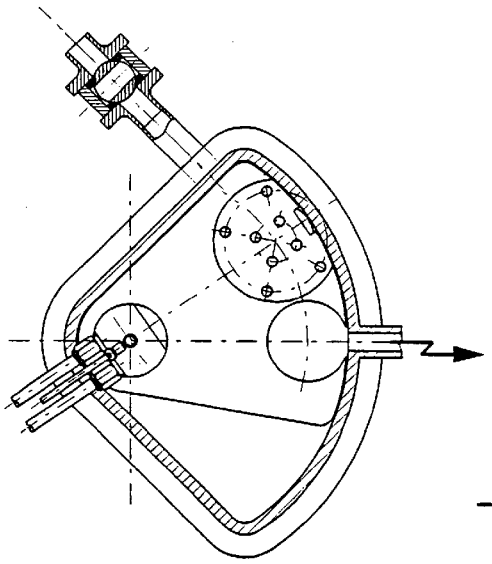
Figure 4:
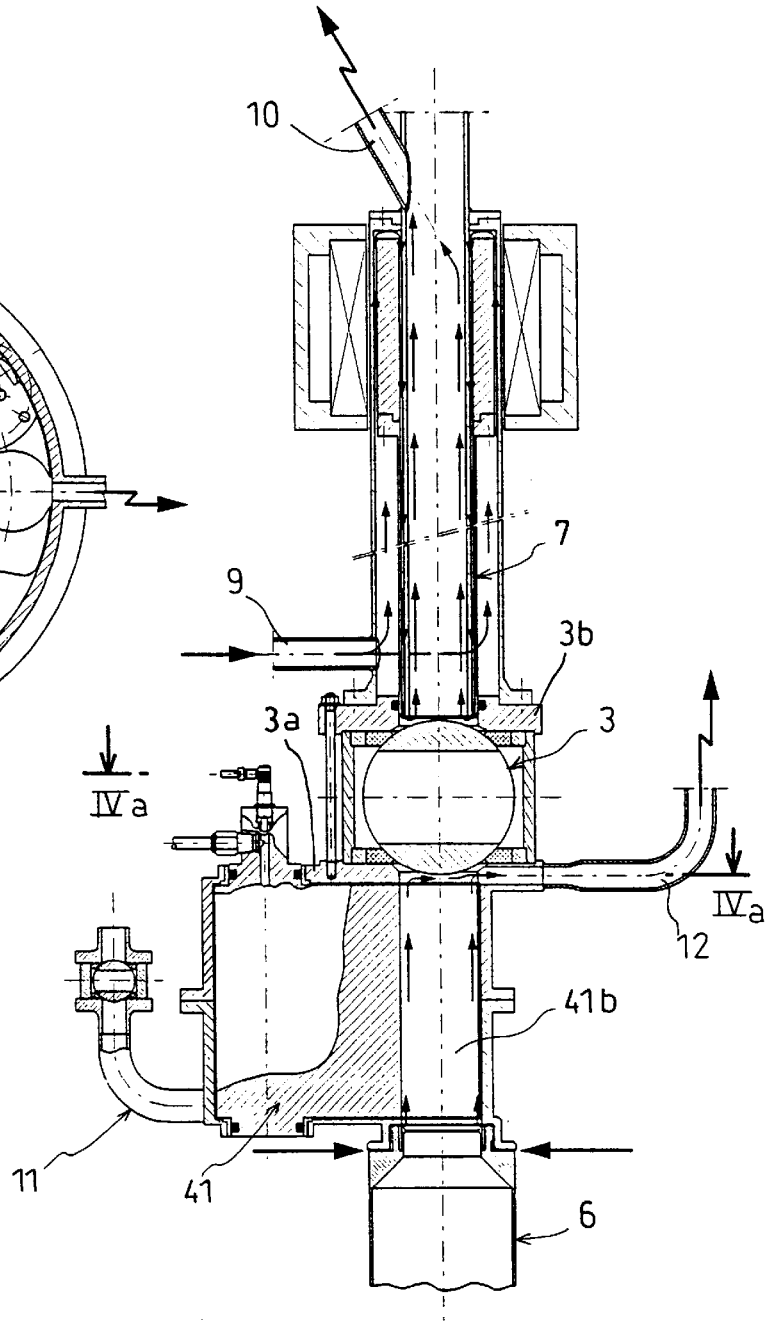

Once the lid 6*a* has been removed, the inside of the container 6 is in communication with the bottom ventilation circuit (FIG. 3). After the magazine 41 has pivoted, the surrounding atmosphere as sucked in rises preferentially via the recess 41*b* placed in register with the container 6 (FIG. 4).

After said container 6 has been filled to the desired extent, and the valve 3 has again been closed, the bottom circuit is again in the above configuration. Provision is then made to perform a specific sweep of the bottom face of the retracted lid 6*b*. For this purpose, the admission duct 11 is opened and the container 6 is docked without contact. (Said admission duct 11 is opened and closed under the control of the valve 11*a*.) This disposition enhances sweeping both between the magazine 41 and the case 4, and also inside the recess 41*a* in which the lid is received.

After this specific sweep, the magazine 41 is pivoted to its position for putting the lid 6*b* back into place. The lid 6 is undocked to a small extent and the closable admission duct 11 is closed again. The bottom circuit is thus restored to its initial position.

Figure 5A:
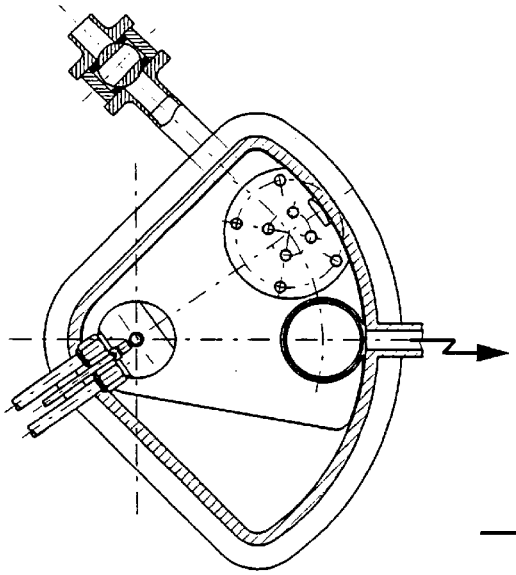
Figure 5:
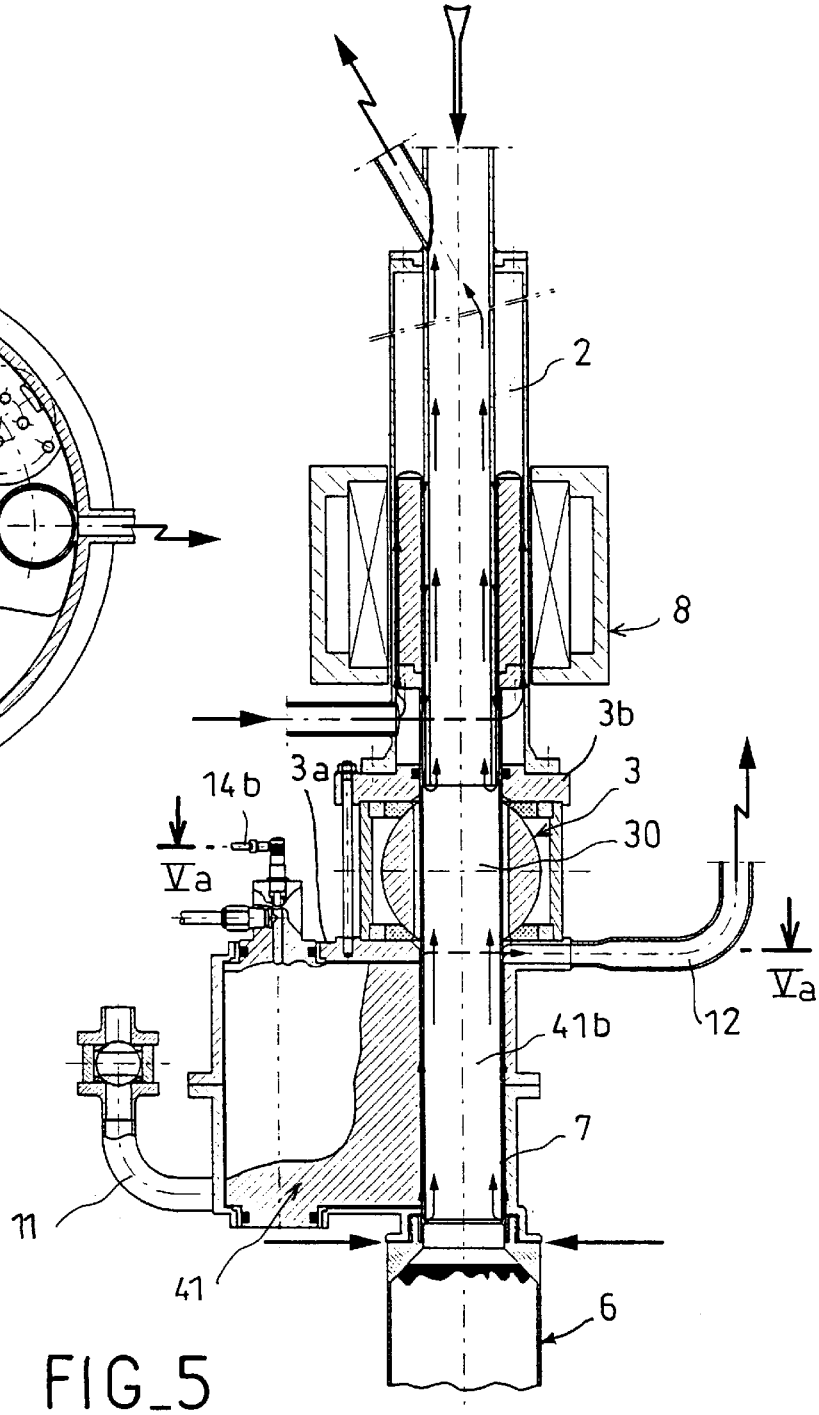
Figure 6A:
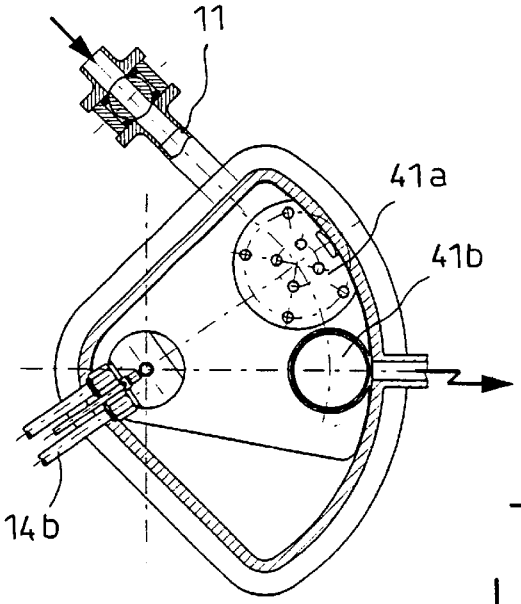
Figure 6:
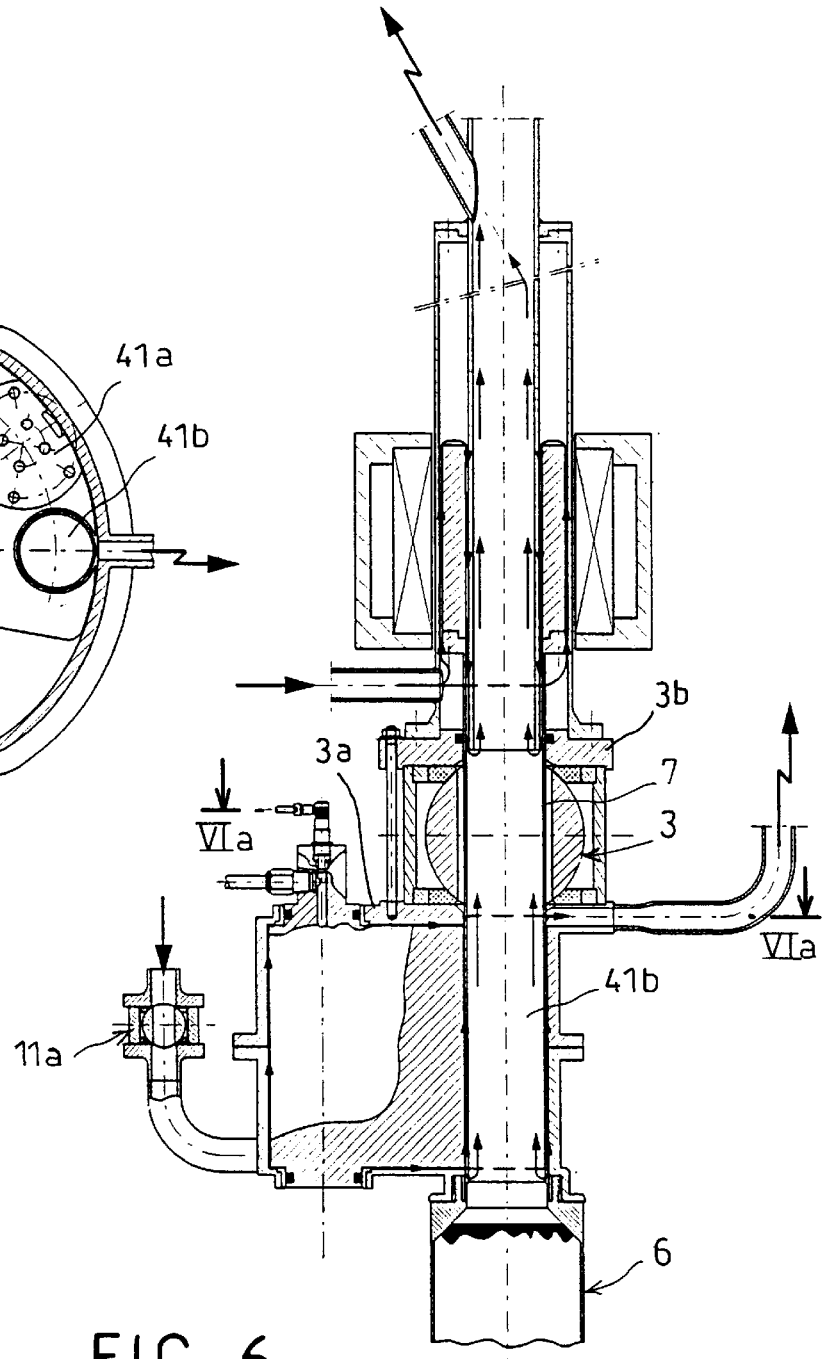

It is emphasized that throughout this stage in which the spherical valve 3 is closed, the atmosphere sucked into the bottom circuit sweeps over the portion of the outside surface of the spherical valve plug that is exposed in register with the opening in the bottom flange 3*a*, thereby preventing any powder being deposited in said zone.

b) The spherical valve 3 is open and the coupling tube 7 is in its low position (FIGS. 5 and 6).

Said coupling tube 7 puts the inside of the container 6 into communication with the top ventilation circuit throughout the time that filling takes place. It isolates the inside of the container 6 from the bottom circuit which continues to ventilate the clearances that exist between the case 4, the magazine 41, and the outside face of the coupling tube 7.

During filling, the small amount of clearance that is maintained at the docking between the port 5, the container 6, and the bottom edge of the coupling tube 7 (to make it possible to weigh the container 6 if so desired) puts both ventilation circuits into communication with the surrounding atmosphere.

A small flow of said surrounding atmosphere is sucked in through the clearance between the port 5 of the case 4 and the container 6. It then reaches the clearance that remains between the neck 6*a* of the container 6 and the bottom edge of the coupling tube 7. At this point, it splits between the inside of the coupling tube 7 from which it is sucked via the top ventilation circuit, and the outside of the coupling tube 7 from which it is sucked by the bottom ventilation circuit, which it enters after passing through the case 4. This disposition establishes dynamic sealing at the clearance between the neck 6*a* of the container 6 and the bottom edge of the coupling tube 7. It prevents any powder being entrained through this clearance from the powder-feed duct 1 into the case, or to the outside, and it enables the neck of the container to be swept.

The apparatus of FIGS. 11 to 17 and its method of operation are described in greater detail below. The description of this apparatus is concise insofar as the elements it has in common with the apparatus shown in FIGS. 1 to 10 have already been described in detail above with reference to said FIGS. 1 to 10. Said apparatus of FIGS. 11 to 17 is particularly adapted to filling containers 6 that do not have a neck. It has a case 4 containing a slide 42 that can be moved sideways between a position for taking hold of the lid 6*b* of the container 6 and a position for retracting said lid 6*b* and leaving open the mouth 5*a* of the port 5.

In said position for taking hold of the lid 6*b* (FIG. 11), the slide 42 places a recess over said lid, which recess is fitted with pneumatic means for taking hold of said lid 6*b*, for retaining it, and for depositing it. After said slide 42 has been moved to one side, the container 6 is raised into the mouth 5*a* of the port 5 so as to come flush with the bottom flange 3*a* of the valve body 3 (FIG. 12), but without contacting it.

Figure 13:
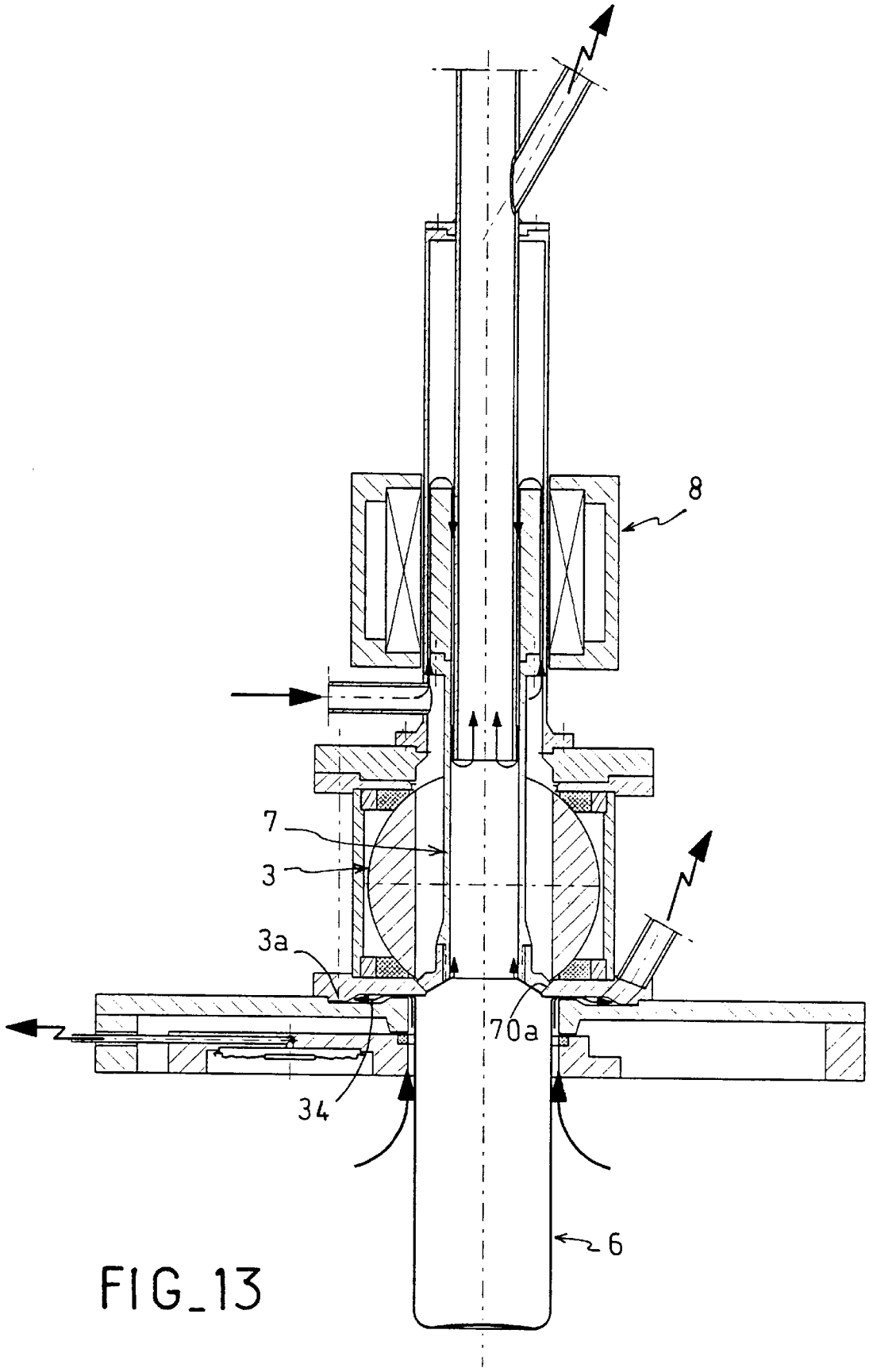

Said valve 3 is opened—thereby forming a well by brining into vertical alignment the powder-feed duct 1, the cylindrical passage 30 through the valve 3, and the mouth of the container 6—and the coupling tube 7 is lowered by the electromagnetic means (FIGS. 13).

In this variant of the invention, the well does not go through the case. The coupling tube 7 is provided with a flared endpiece 70 at its bottom end. This flared endpiece 70 has two contact surfaces 70*a* and 70*b*.

When the coupling tube 7 is in its high position (FIGS. 11 and 12), the top contact surface 70*b* is in sealed abutment against a shoulder of the top flange 3*b* of the valve 3. When said coupling tube 7 is in its low position (FIGS. 13 and 14), the bottom contact surface 70*a* is in sealed abutment against the shoulder of the bottom flange 3*a* of said valve 3.

Figure 14:
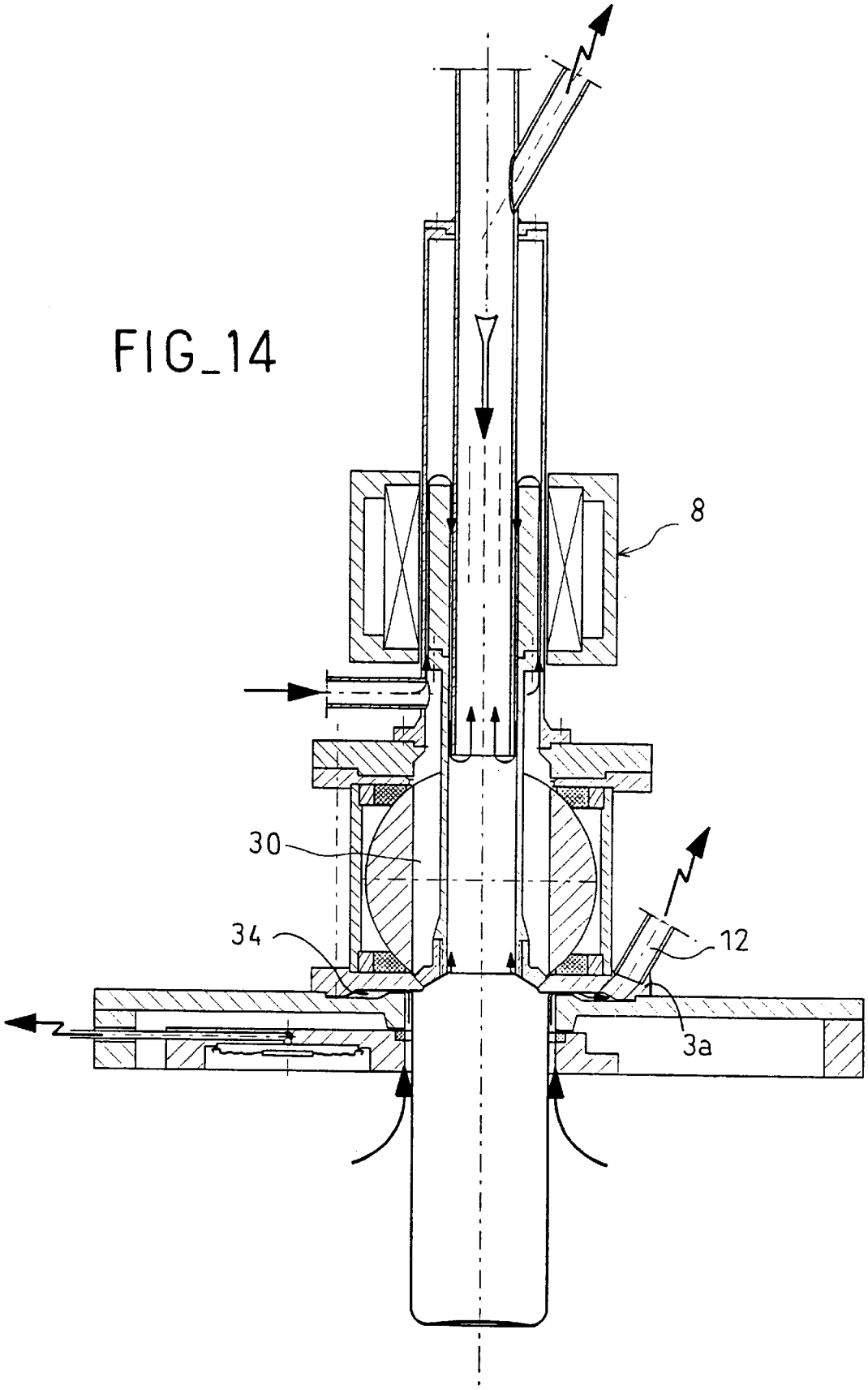
Figure 15:
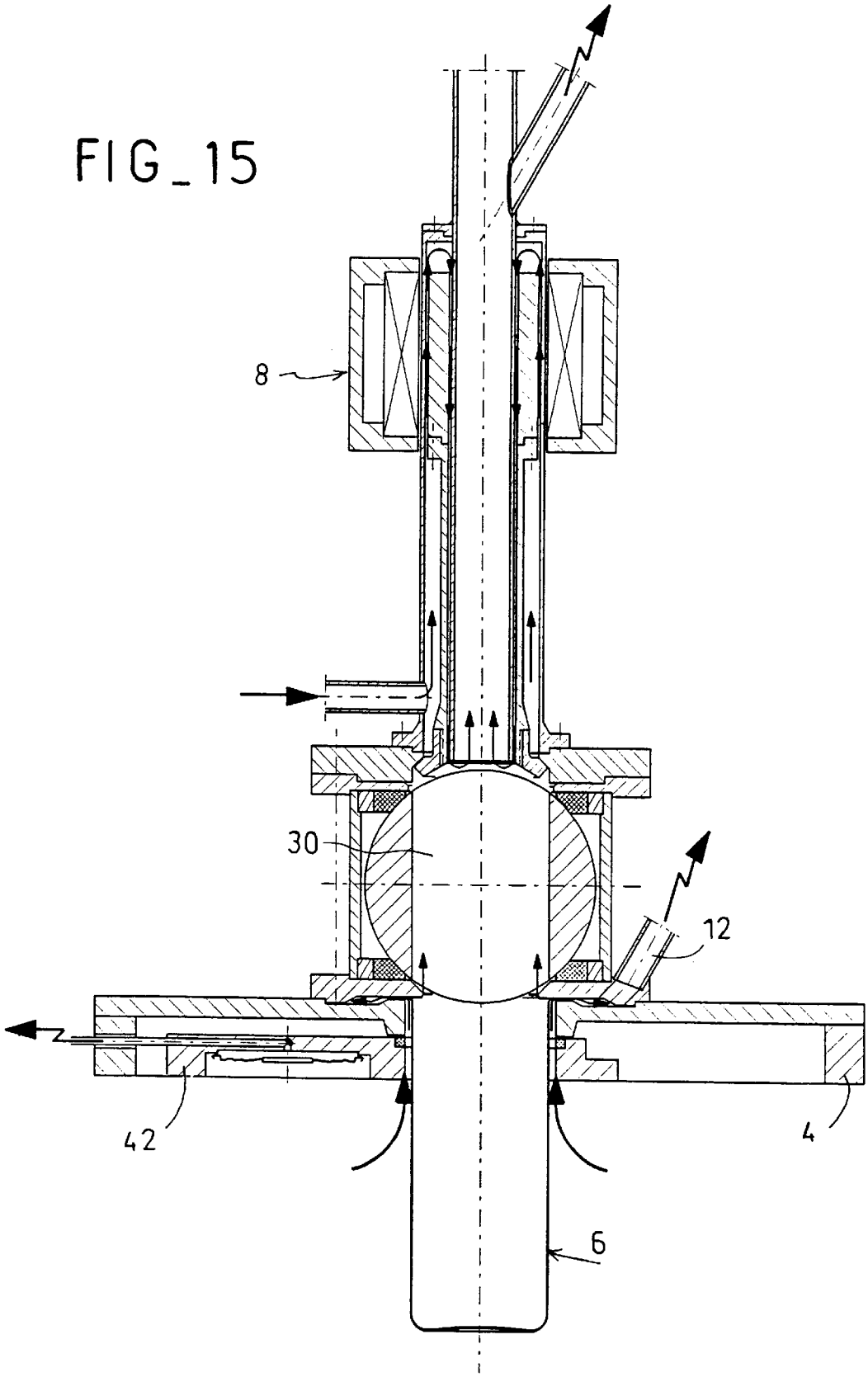

The powder is then inserted into the container 6 through the lined well, thereby preventing any contact between the powder and the internal mechanical parts of the apparatus (FIG. 14).

Figure 16:
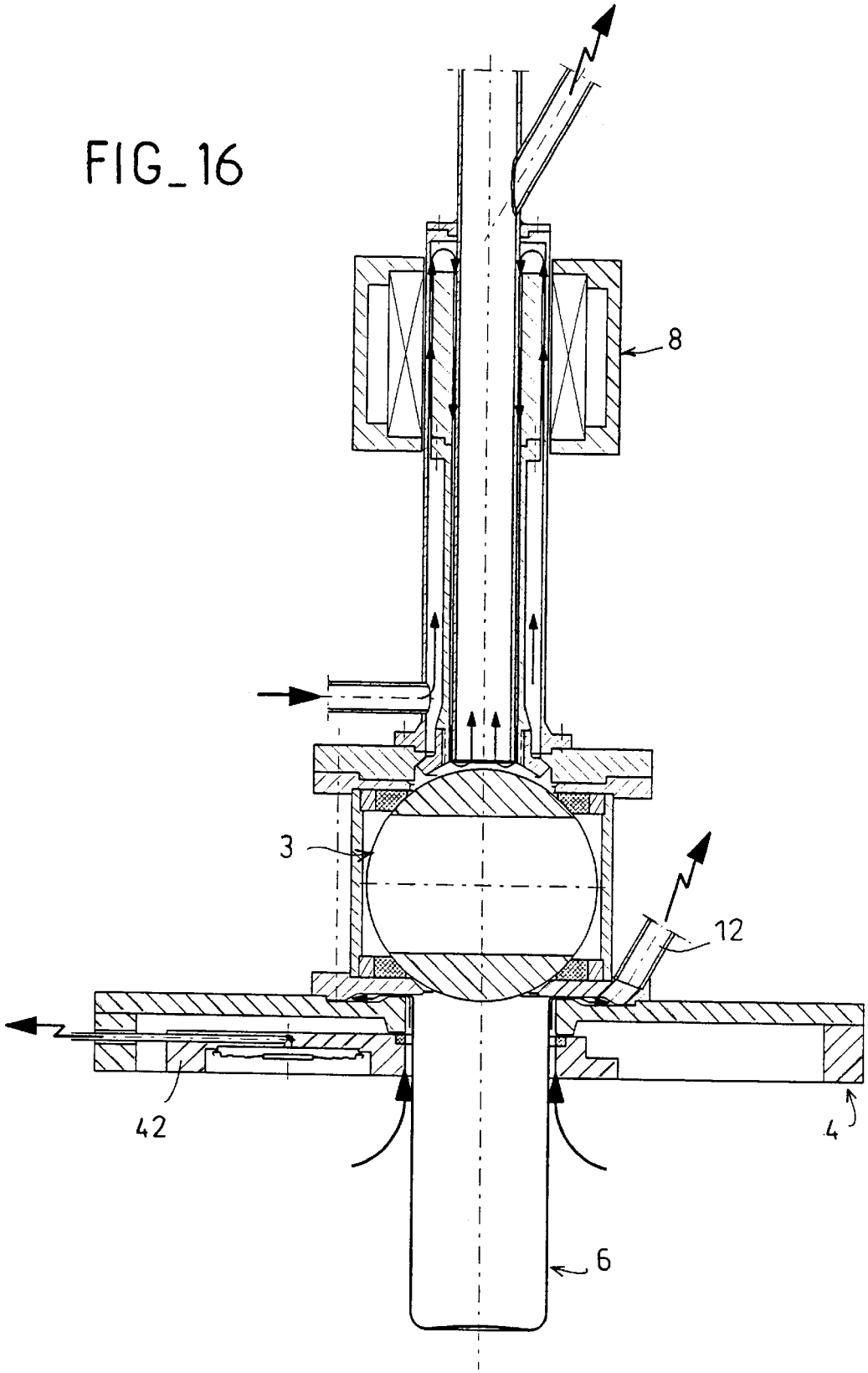

As above, once the container 6 docked in this way has been filled, it can be weighed. Once the container 6 has been filled (to the desired level), the coupling tube 7 is raised into its initial high position (FIG. 15), and then the valve 3 is closed (FIG. 16).

The container 6 is then lowered into the mouth 5*a* of the port 5 of the case 4 so as to release the passage for the slide 42 in which the lid 6*b* is retained.

Figure 17:
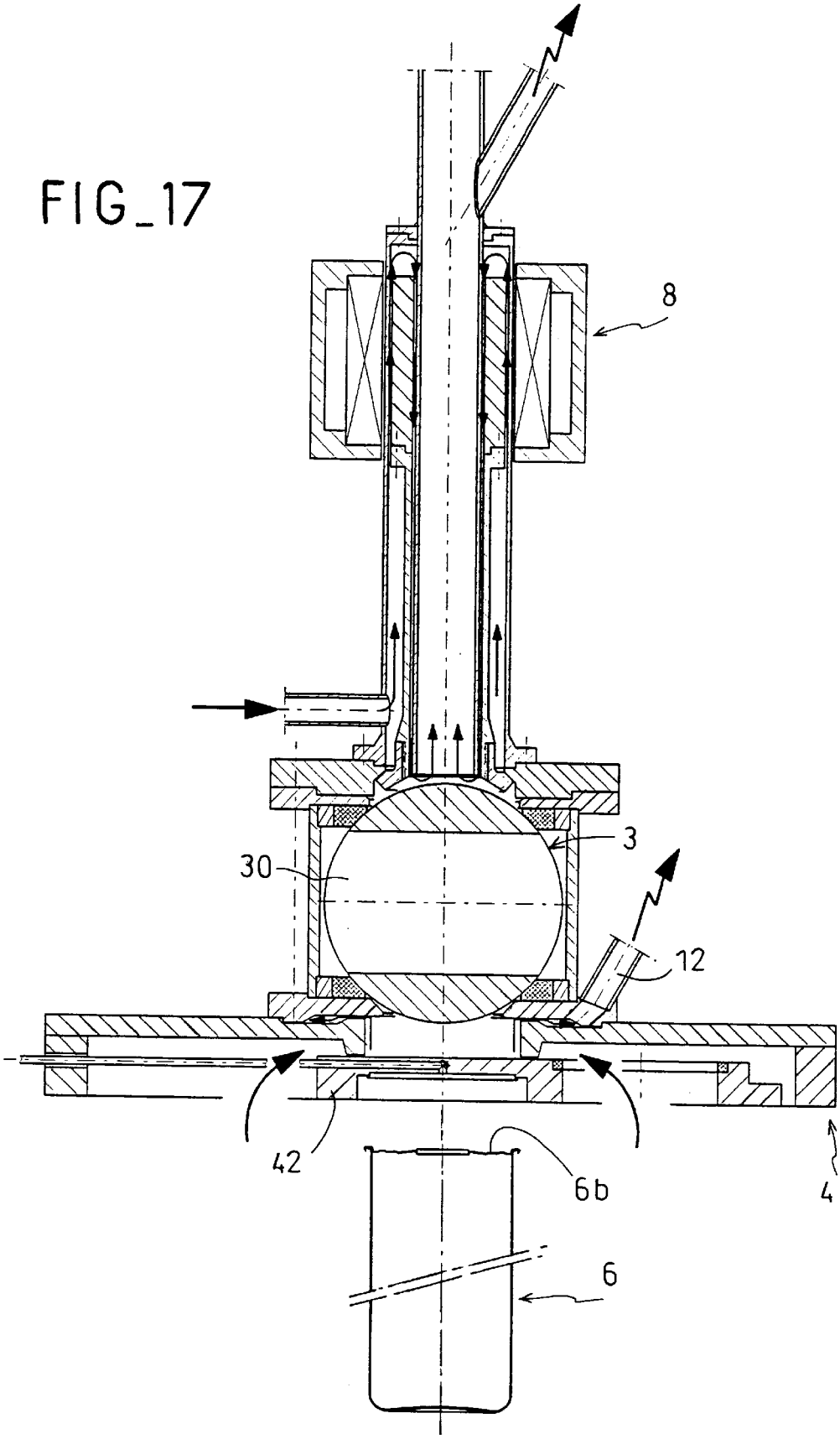

The slide 42 is then moved back over the container 6 so as to place the lid 6*b* thereon. The full container 6 closed by its lid 6*b* is then undocked and can be transferred to a following unit (FIG. 17).

As above, the ventilation which performs dynamic confinement is described below in greater detail with reference to said FIGS. 11 to 17.

The ventilation system is constituted in the same manner by a top circuit and a bottom circuit. The top circuit is identical to that of FIGS. 1 to 10. The bottom circuit is formed by the spaces that exist between the case 4, the slide 42, and the container 6. It is fed with surrounding atmosphere via the clearances situated between the mouth 5*a* of the port 5 and the wall of the container 6. It communicates with the filter assemblies via the suction orifice 12 disposed at the top of the case 4.

Figure 11:
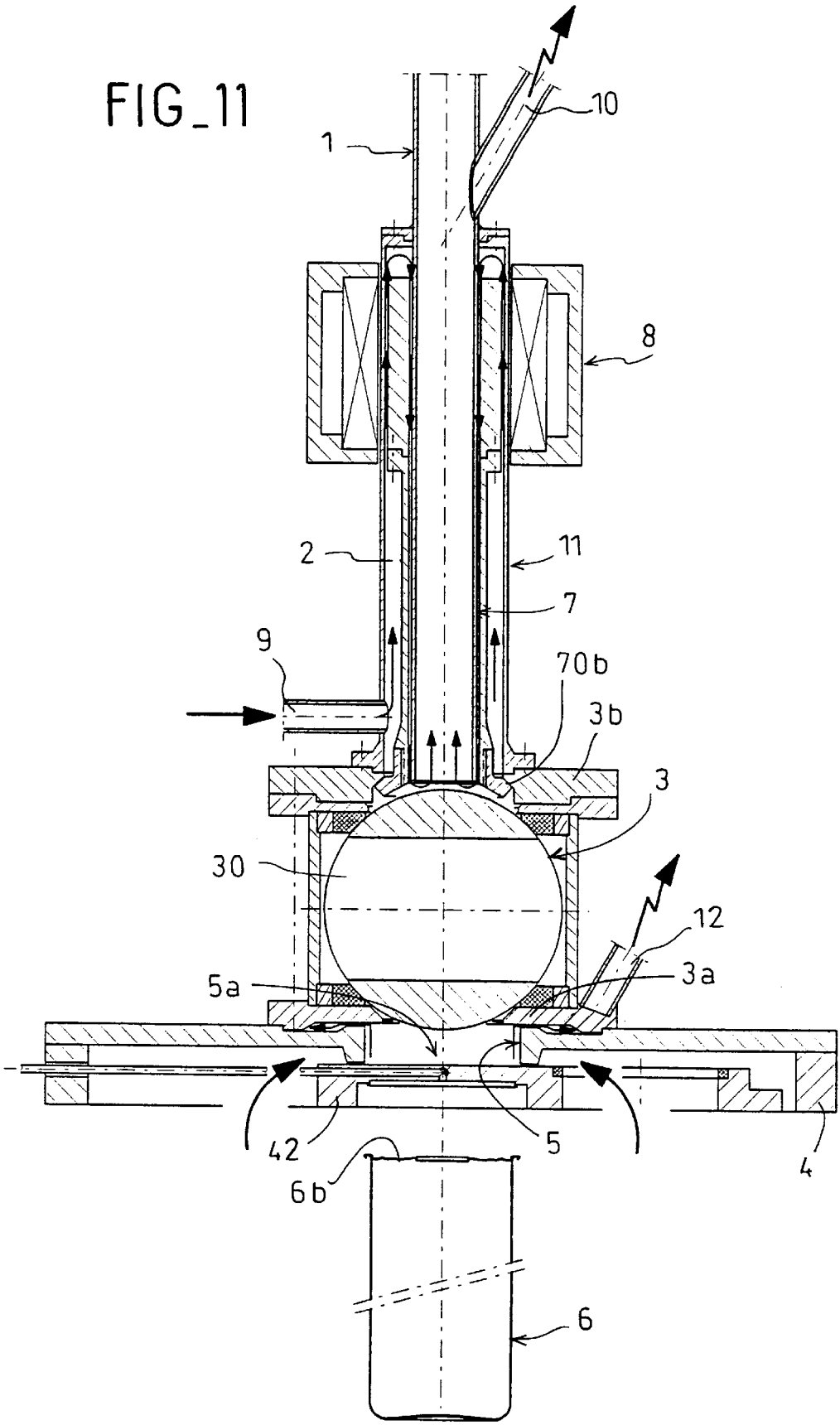
FIGS. 11 to 17 are longitudinal sections in elevation showing a second variant of said apparatus during the various stages of implementing said method. The following legends are proposed for these figures.
Figure 12:
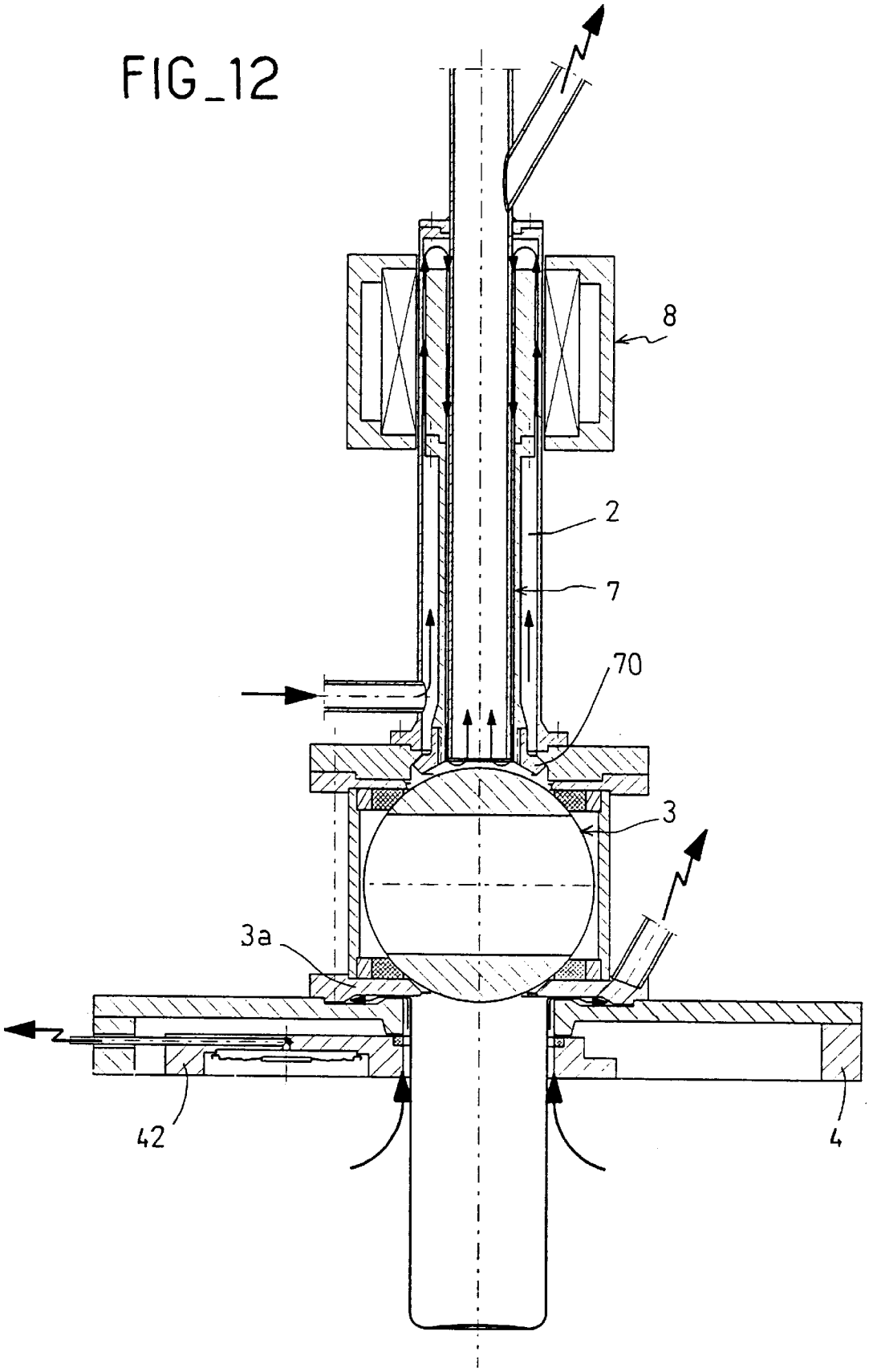

Ventilation operates in two different ways:

a) The spherical valve 3 is closed and isolates the top and bottom ventilation circuits from each other. The coupling tube 7 is raised and surrounds the powder-feed duct 1 (FIGS. 11 and 12). The top and bottom ventilation circuits then operate completely independently of each other.

In the top circuit, ventilation takes place as described with reference to FIGS. 1 to 10.

In the bottom circuit, the outside atmosphere is sucked in towards the suction orifice 12 via the clearances that exist between the case 4, the bottom flange 3*a* of the valve 3, and the container 6 (or the slide 42 when the slide is on the axis of the mouth 5*a* of the port 5 and the container 6 is disengaged).

Throughout this stage during which the valve 3 is closed, the surrounding atmosphere as sucked into the top circuit sweeps that portion of the outside surface of the spherical valve plug that is exposed in register with the opening in the top flange 3*b* of the valve 3, and the atmosphere sucked into the bottom circuit sweeps that portion of the outside surface of the spherical valve plug that is exposed in register with the opening in the bottom flange 3*a* of said valve 3; this prevents any powder being deposited in said zones.

b) The spherical valve 3 is open and the coupling tube 7 is in its low position (FIGS. 13 and 14).

Said coupling tube 7 puts the inside of the container 6 into communication with the top ventilation circuit throughout the time that filling takes place. It isolates the inside of the container 6 from the bottom circuit which continues to ventilate the clearances between the case 4, the bottom flange 3*a* of the valve, and the outside wall of the container 6.

While filling is taking place, the small amount of clearance maintained at the docking between the port 5, the container 6, and the bottom flange 3*a* puts both ventilation circuits into communication with the surrounding atmosphere.

A small flow of said surrounding atmosphere is sucked in through the clearance between the port 5 of the case 4 and the container 6. It then reaches the clearance that exists between said container 6 and the bottom flange 3*a*.

At this point it splits between the inside of the coupling tube 7 from which it is sucked out via the top ventilation circuit, and the annular space 34 that exists between the case 4 and the bottom flange 3*a* from which it is sucked out by the bottom ventilation circuit. This deposition establishes dynamic sealing at the clearance that exists between the top of the container 6 and the bottom flange 3*a* of the valve 3.

This prevents powder being entrained through said clearance from the powder-feed duct 1 into the case 4, and enables the top portion of the container 6 to be swept.

What is claimed is:

1. A method of filling with powder a container having an interior and an opening to the interior that is closable by a lid, said method comprising the steps of:

docking the opening in the container with a transfer apparatus including a powder-feed duct for feeding said powder and means for placing the duct into communication with the interior of said container;

dropping a coupling tube vertically downwardly through the duct to communicate with the interior of the container;

passing said powder vertically downwardly through said transfer apparatus downstream from said powder-feed duct through said coupling tube to said container, the coupling tube serving to protect internal mechanical parts of said transfer apparatus; and during said transfer, maintaining a low level of suction inside said transfer apparatus, including inside at least a bottom end of said powder-feed duct in order to provide permanent ventilation and thus avoid any accumulation of the powder and any release of the powder external to the apparatus.

2. The method according to claim 1, wherein said transfer apparatus includes, from top to bottom:

the vertical duct for feeding the powder;

a spherical valve having a cylindrical passage therethrough; and a case enabling the container without lid to be docked, the case containing means for temporarily retracting the lid, wherein said ventilation is provided by two mutually independent circuits including an upper circuit for vertical duct and a lower circuit for said case.

3. The method according to claim 2, wherein said ventilation in the bottom circuit is performed successively in two modes of operation, including a mode serving specifically to sweep a zone in which a retracted lid is housed, and in particular to sweep a bottom face of the lid.

4. An apparatus for transferring a powder into an interior of a container that is closable by a lid, the apparatus comprising:

in a top portion, a vertical powder-feed duct for feeding said powder, constructed and arranged in a top end thereof for connection to a device for feeding the apparatus with the powder, said powder-feed duct being surrounded over a defined height starting from a bottom end thereof by a cylindrical sleeve, said duct and said sleeve defining an annular space that is closed at a top end thereof;

in a bottom portion, a case comprising means for taking hold of a lid of the container, for retracting the lid, and for replacing the lid, and a vertical cylindrical recess that is open at top and bottom ends thereof, the recess having a shape enabling docking with a top portion of the container without lid;

a spherical valve having a through cylindrical passage disposed between said case and the bottom end of said vertical duct, and when in an open position, comprising means for communicating between said vertical duct and the interior of said container;

a cylindrical coupling tube and means for moving said tube between an upper position in which the coupling tube is received inside the annular space defined by the bottom end of said duct and said sleeve, and a lower position in which a bottom end of the coupling tube is situated substantially level with a top portion of the container without lid while a top end of the coupling tube remains in said annular space, said coupling tube in its lower position serving to line the inside of at least the cylindrical passage through the valve; and ventilation means for ventilating within said apparatus.

5. The apparatus according to claim 4, wherein said ventilation means comprise two mutually independent circuits including:

an upper circuit for sweeping within the vertical duct, and annular spaces that exist respectively between an outside wall of said vertical duct and an inside wall of the cylindrical coupling tube, and between an outside wall of said cylindrical coupling tube and an inside wall of the cylindrical sleeve; and a lower circuit for sweeping within the case.

6. The apparatus according to claim 4, wherein the means for moving the coupling tube comprise electromagnetic means.

7. The apparatus according to claim 4, particularly adapted to filling a container having a neck, wherein said case is provided with a bottom docking port of profile that matches the neck of the container and containing a magazine that is mounted to pivot about a vertical axis, said magazine having two vertical recesses, including a first recess open at top and bottom ends thereof to constitute a passage for the coupling tube through said magazine, said passage being capable of placement in alignment with said vertical powder-feed duct, the cylindrical passage through the valve, and the neck of the container to constitute a well that is lined by said coupling tube when in the lower position during filling, and a second recess opening out solely at a bottom end thereof and containing means for taking hold of the lid of the container, for retracting the lid, and for replacing the lid.

8. The apparatus according to claim 7, wherein said means contained in said second recess comprise a pneumatic actuator having disposed at a bottom end thereof an electromagnetic member for taking hold of the lid.

9. The apparatus according to claim 7, wherein said case is provided with a closable admission duct and with a suction duct.

10. The apparatus according to claim 4, particularly adapted to filling a container that does not have a neck, wherein said case is provided with a port for enabling docking with the container, and containing a slide that is movable sideways between a position for taking hold of the lid of the container and for replacing the lid, and a disengaged position releasing said port, said slide being fitted with means for taking hold of said lid, for retracting the lid, and for replacing the lid.

11. The apparatus according to claim 10, wherein the cylindrical coupling tube has a flared endpiece at a bottom end thereof, the endpiece being shaped such that when in the upper position the endpiece co-operates with a top flange of the valve, and when in the lower position the endpiece co-operates with a bottom flange of said valve for sealing purposes.

12. The apparatus according to claim 10, wherein the means for taking hold of said lid, for retracting the lid, and for replacing the lid comprises pneumatic means.

13. The apparatus according to claim 4, including weighing means on which the container stands during transfer.

* * * * *